US006318481B1

(12) United States Patent
Schoeffler

(10) Patent No.: US 6,318,481 B1
(45) Date of Patent: Nov. 20, 2001

(54) DRILL STRING DEFLECTOR SUB

(75) Inventor: William N. Schoeffler, Lafayette, LA (US)

(73) Assignee: Quantum Drilling Motors, Inc., Lafayette, LA (US)

( * ) Notice: Subject to any disclaimer, the term of this patent is extended or adjusted under 35 U.S.C. 154(b) by 0 days.

(21) Appl. No.: 09/215,937

(22) Filed: Dec. 18, 1998

(51) Int. Cl.[7] ..... E21B 7/04
(52) U.S. Cl. ..... 175/73; 175/76
(58) Field of Search ..... 175/73, 74, 76, 175/61, 317, 101, 106

(56) References Cited

U.S. PATENT DOCUMENTS 3,595,326 * 7/1971 Claycomb ..... 175/73
4,572,305 * 2/1986 Swietlik ..... 175/325
4,655,299 4/1987 Schoeffler .
4,715,453 * 12/1987 Falgout, Sr. et al. ..... 175/73
4,895,214 1/1990 Schoeffler .
5,553,678 * 9/1996 Barr et al. ..... 175/73
5,941,321 * 8/1999 Hughes ..... 175/61
5,979,570 * 11/1999 McLoughlin et al. ..... 175/24

* cited by examiner

*Primary Examiner*—Thomas B. Will
*Assistant Examiner*—Kristine M. Markovich

(57) ABSTRACT

The apparatus serves as a length of drill string and has a valve actuatable from the surface that restricts the drilling fluid channel to produce a pressure drop within the apparatus. The pressure drop is used to move a piston which moves a side loading element against a well bore wall to urge the drill string toward the opposite wall to cause a progressing drill head to change direction. The housing that carries the side load element has a clutch that rotationally disengages the housing from the drill string when the element is extended. The drill string can drill as a rotary system while the side loading element is stationary relative to earth.

12 Claims, 2 Drawing Sheets

DRILL STRING DEFLECTOR SUB

This invention pertains to apparatus for use on drill strings near the drill head to deflect the progressing well bore from an existing centerline. More specifically, the apparatus reacts to commands from the surface to extend and retract a well bore wall engaging element from the apparatus to produce a side load on a drill head to deflect the well bore.

BACKGROUND

The need for control of the direction in which a bore hole progresses has always been desirable and the ability to reliably and accurately do so has improved markedly in recent years. With the advent of measurement while drilling, or MWD, directional drilling control became more frequently a drilling requirement.

Passive directional controls, applied historically, include the use and placement of stabilizers along the lower sections of the drill collars. Success of this system depended largely upon the drillers skill and experience. That approach is often considered more art than science.

Active directional controls, more recently employed, apply positive influence upon the drilling assembly and include the rather cumbersome use of whipstocks. More complex and about as capable are the systems for bending the active drill string just above the drill head. Hinge type devices are effective but tend to weaken the drill string. Permanently bent elements of the drill string usually require the use of drilling motors. Drilling motors, generally, do not have the ability to fully utilize the available hydraulic horsepower of the mud stream but, overall, their use is often economically advantageous.

When permanently bent sections of drill string are used, drilling motors are normally involved and straight hole drilling is usually accomplished by rotating the drill string. That rather deranges the force vectors in the lower end of the drill string and the drill head. In some formations, rotating a bent string produces unacceptable stresses in the lower drill string assembly.

It is desirable to provide means to deflect the course of the progressing drill head, only when needed for directional control, by directing a lateral force between the drill string and the well bore wall in the vicinity of the drill head. The reaction force at the drill head tends to deflect the course of the advancing bore hole. The drill string remains generally straight to better accept bit load vectors directed along the general centerline of the drill string. Rotary drilling without down hole motors can proceed if the side loading contrivance can remain rotationally stationary relative to earth while the drill string rotates.

It is therefore an object of this invention to provide means to extend an element from the drill string to engage, and apply a deflecting lateral force against, the well bore wall, and to retract the element when the lateral deflection is no longer needed.

It is still another object of this invention to provide apparatus that can be actuated to change between directional and straight hole drilling configuration by manipulation of the drilling fluid flow rate controls at the surface.

It is yet another object of this invention to provide apparatus to apply a deflection producing lateral force between a well bore wall and a drill string and maintain the lateral force producing means stationary while the drill string rotates to drill.

These and other objects, advantages, and features of this invention will be apparent to those skilled in the art from a consideration of this specification, including the attached claims and appended drawings.

SUMMARY OF INVENTION

The apparatus functions as a length element of the drill string, near the drill head. A side loading element of the general configuration of a stabilizer blade is movably situated to extend from, and retract into, the outer wall of the apparatus. A hydraulic cylinder, powered by drilling fluid pressure drop across a control valve, moves to cause the element to extend. When the extending force is removed, by reduction of drilling fluid flow, a spring reverses the movement of the cylinder piston to retract the element. The movement that retracts the element also engages a clutch to rotationally secure the housing to the arbor. The control valve is, preferably, responsive to preselected manipulation of drilling fluid flow rate controls at the surface. By actuation of different drilling fluid flow rate control processes, the fluid power is not applied to the cylinder and the spring retracts the element. In the preferred embodiment extension and retraction occurs on alternate occasions of increasing drilling fluid flow from a preselected lower flow rate, including no flow. The flow rate characteristic that controls is then the act of following a prior flow increase with another increase after reducing the flow rate. Otherwise stated, odd occasions of flow increase will extend the element and even occasions of flow rate increase will retract the element. Other valve actuating processes may be used to exercise controls, by design choices. Several suitable valve actuators are now in the art.

The side loading element is carried by a housing of generally cylindrical configuration that is free to rotate about the periphery of the drill string. Rotary drilling can proceed while the housing is rotationally stationary. The housing is arranged to be rotationally locked to the drill string for purposes of orientation and straight hole drilling. The housing locking state is coincident with retraction of the loading element. Once positioned rotationally, a signal is generated at the surface to activate the valve to extend the loading element, which also unlocks the housing. The rotationally stationary, or unlocked, housing moves axially with the drill string as the well is deepened. Eventually, the orienting process needs to be repeated to assure that the side loading element is properly oriented.

In some cases, a stabilizer is best used between the side loading element and the drill head. In such cases the stabilizer acts as a fulcrum and the drill head is deflected in the direction of the side loading element. Such use of stabilizers is in the art.

BRIEF DESCRIPTION OF DRAWINGS

In the drawings wherein like features have similar captions.

DETAILED DESCRIPTION OF DRAWINGS

Figure 1:
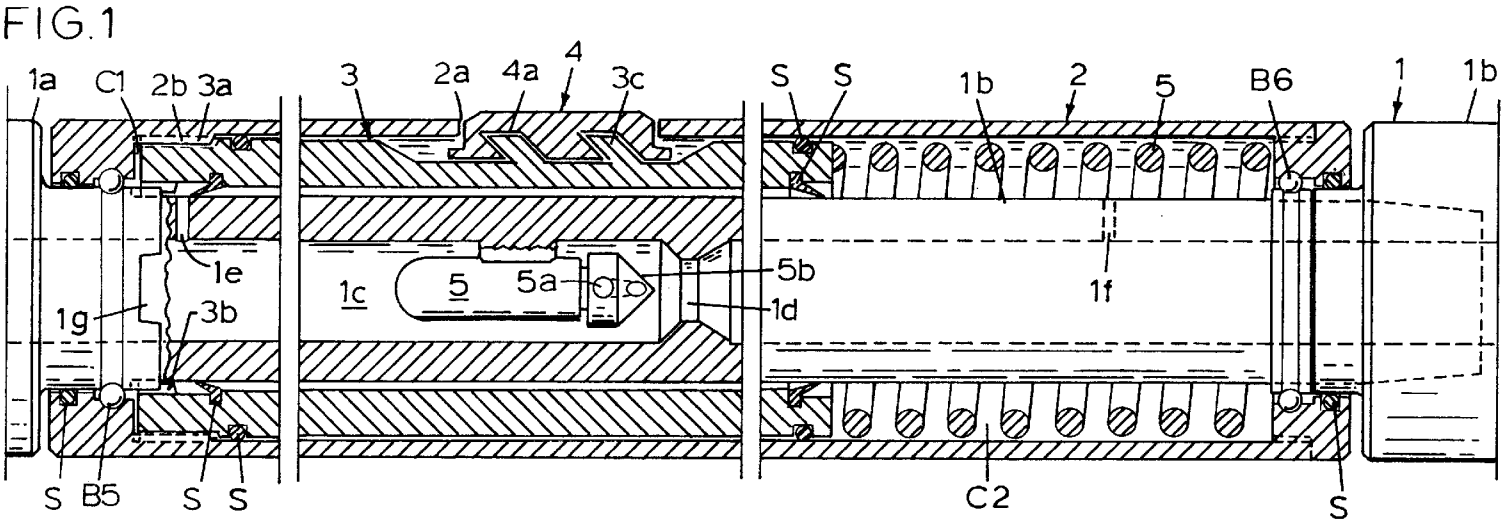
FIG. 1 is a side elevation, mostly cut away, of the preferred embodiment of the invention.

In the drawings features that are well established in the art and do not bear upon points of novelty are omitted in the interest of descriptive clarity. Such omitted features may include threaded junctures, weld lines, sealing elements, pins and brazed junctures.

FIG. 1 shows the non-actuated state of the apparatus. The apparatus functions as a length of drill string, with connections (not shown) for attachment to a continuing drill string component at ends 1*a* and 1*b*. Housing 2 is bearingly supported for axial constraint and rotation on arbor 1, about reduced diameter 1*b*. Annular piston 3 is sealingly situated between fluid chambers C1 and C2. Seals s at opposite ends of the housing and opposite ends of the annular piston define the chambers. Spring 5 is situated in chamber C2 and urges the piston 3 to the left limit of travel. At the left limit of travel, piston clutch teeth 3*b* engage arbor clutch notches, one wide notch is shown as 1*g*, to rotationally secure the piston to the arbor and drill string. The housing is, then, rotationally secured to the drill string by way of piston spline teeth 3*a* which are in constant engagement with housing spline teeth 2*b*. Clutch notch 1*g* is wider than all other clutch notches and clutch tooth 3*d*, FIG. 2, will enter no other notch. This enables the orienting function whereby a drill string scribe line will have only one relationship to the side loading element 4 when the clutch is engaged. That enables the driller at the surface to orient the apparatus relative to earth during directional drilling related activity, and to rotate the entire down hole assembly for straight hole drilling.

Drilling fluid channel 1*c* extends axially through the tool and has restriction 1*d* which cooperates with poppet 5*b* to provide a valve. The poppet is controlled by controller 5. The valve will essentially close to actuate the apparatus. By-pass channel 5*a* avoids complete closure of the drilling fluid circuit. The by-pass location is a convenience, it could be located in the wall of arbor 1. When the valve closes, pressure in channel 1*c* upstream of the valve passes through port 1*e* to chamber C1. All seals are captioned S. Pressure downstream of the valve passes through port if into chamber C2. The pressure difference across the valve is imposed on the piston to move it to the right. That movement frees the clutch and allows the housing to freely rotate on the arbor.

The specific valve to be first used in this apparatus is not part of claimed matter. Any valve that has the flow restriction range needed will control the piston. Valve operators may include such as balls dropped down the drill string bore from the surface, or other valves in the art. Preferably, the valve should be capable of actuation in response to signals from the earth surface. Balls or other objects dropped down the drill string bore to cause a desired effect, as well as fluid borne pressure signals qualify as external signals or signals from the surface.

Side loading element 4 is situated to extend through window 2*a* in the wall of the housing, for radial movement toward a well bore wall. Radial movement is controlled by cams 3*c* on piston 3, acting in recesses 4*a*. When the piston moves to the right, downstream, the side loading element 4 moves outward. The element extends enough to engage the well bore wall and push the drill string toward the opposite wall of the well.

When the valve opens, the pressure in channel 1*c* differs little between ports 1*e* and 1*f*. Spring 5 urges the piston upward, to the left. Element 4 is withdrawn and the clutch will engage when notch 1*g* encounters tooth 3*d*. A plurality of teeth carry the clutch rotational load once the clutch is engaged.

In the preferred embodiment, valve actuator 5 is responsive to drilling fluid flow controls exercised at the surface. Normally, the actuator responds to alternate onsets of fluid flow to activate the apparatus. Otherwise stated, even occasions of the onset of flow will not actuate the apparatus and odd onsets will actuate it as long as a preselected amount of fluid flows.

Assembly and maintenance considerations dictate some junctures not shown in full detail. Terminal 1*b* is threadedly attached to the arbor, note dashed lines. The end flange on the right end of the housing is threadedly attached to the outer tube of the housing, note dashed lines. Piston 4 consists of three parts with the cams 3*c* captured between piston ends threadedly engaged. The piston shown in FIG. 4 discloses one assembly method.

The bearings B5 and B6 are symbolic. B5 is a combined thrust and radial bearing. Bearing B6 need carry only radial loads.

In one version intended for use with a down hole motor no rolling element bearings are used and the thrust loads are carried by the abutments on terminals 1*a* and 1*b* which engage ends of the housing. Arbor portion 1*h* carries the housing on sleeve bearings. In that version, the housing only rotates to reposition the side load element for orientation purposes.

For small diameter versions of the apparatus the piston area needed for side load element extension requires rearrangement of the mechanism. End-to-end stiffness is enhanced by carrying the bit load through the housing outer sleeve. The arbor cross section is needed for piston area. The arbor is made to telescope at two locations to allow the valve to move with the piston. This is shown in FIG. 4.

Figure 4:
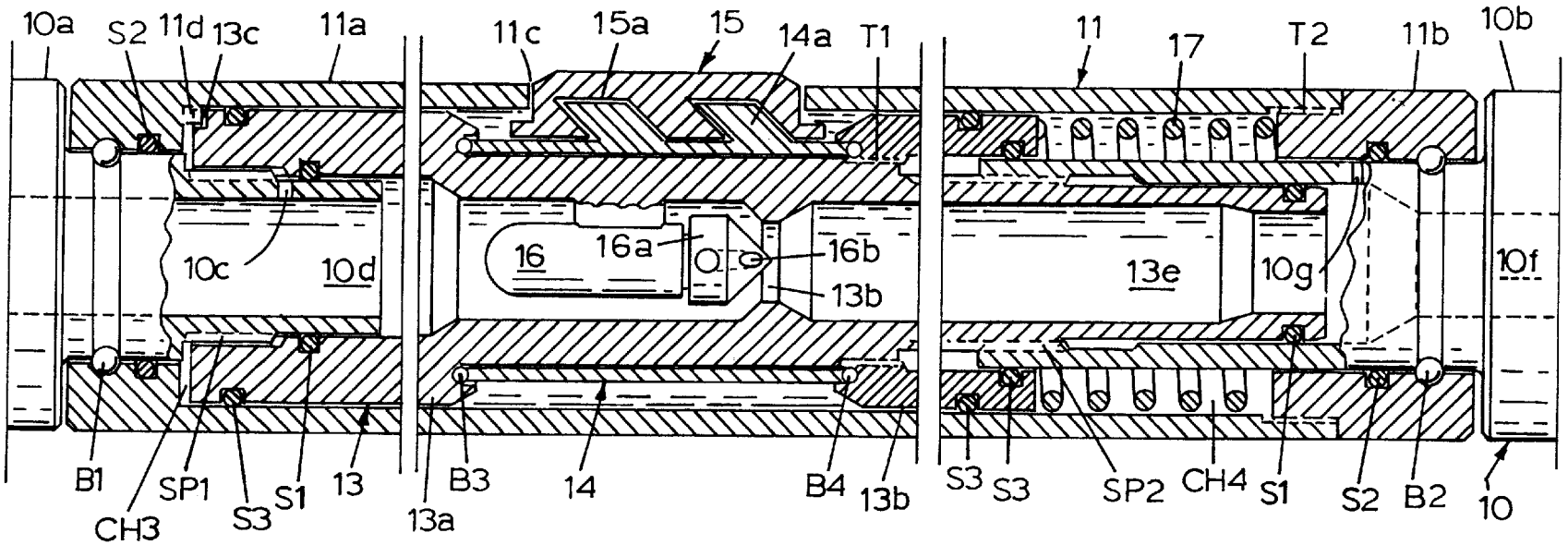
FIG. 4 is an elevation, mostly cut away, of an alternate embodiment of the invention.

In FIG. 4, the slim hole version, the drill string axial forces are transmitted through housing 11 whether it is rotating with the drill string or is rotationally stationary relative to earth.

Housing 11 carries the arbor 10 comprising upper terminal 10*a* and the lower terminal 10*b* on radial and thrust bearings B1 and B2. The terminals have means for fluid tight connections to the extending drill string. These connections are usually tool joint connections (not shown).

The channel to conduct drilling fluid between attached elements of a drill string include channels 10*d*, 13*e* and 10*f*. Related seals are captioned S1. Seals between housing and arbor are designated S2 and other piston seals are designated S3. The window 11*c* is not sealed and mud surrounds cam carrier 14.

Rotational effort of the drill string is transmitted by the piston 13, connected to the upper terminal by spline joint SP1, and to the lower terminal 10*b* by way of splined connection SP2. The housing is sometimes stationary relative to earth and the piston rotates within and cam carrier 14 which is bearingly supported on the piston by way of bearings B3 and B4. Radially extending cams 14*a* are received within recesses 15*a* in side loading element 15. For assembly considerations, the piston is an assembly of part 13*a* and part 13*b* threadedly attached by threads T1 to axially confine the cam carrier for rotation thereon.

The piston 13 moves axially in response to pressure in chamber CH3 and chamber CH4, influenced by spring 17 in chamber CH4. The piston is biased to the left and at the leftward limit of travel clutch teeth 13*c* engage clutch teeth lid on the housing 11. The entire apparatus then rotates with the drill string.

Pressure in chamber CH3 is supplied by port 10*c* from channel 10*d*. Pressure in chamber CH4 is provided by port log in channel 10*f*. The pressure difference in the chambers, required to overcome spring 17, is produced by the partial closure of restrictor 13*d* by valve poppet 16*a*, controlled by valve actuator 16. By-pass port 16*b* prevents closure of the drilling fluid circuit.

Housing 11 is an assembly of sleeve portion 11*a* and end cap 11*b*, threadedly connected by threads T2.

Side loading element 15 extends, and moves, radially through window 11*c*. The amount of extension is such that, when extended in a well bore, it exerts a force on the wall of the well bore to produce a displacing force on the housing to urge it toward the opposite wall of the well bore. When the element is retracted it is under gage in the well for which it is designed and drilling can proceed with the entire apparatus rotating with an attached drill string.

Figure 3:
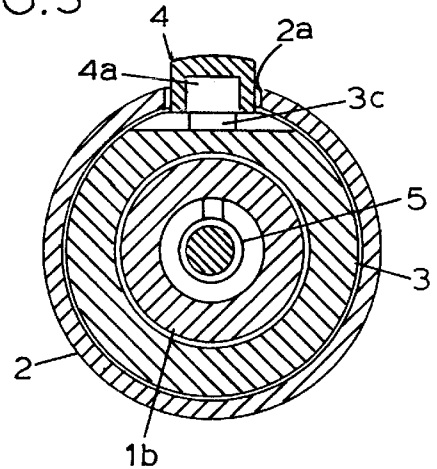
FIG. 3 is a sectional view, taken along line 3—3 of FIG. 2.
Figure 2:
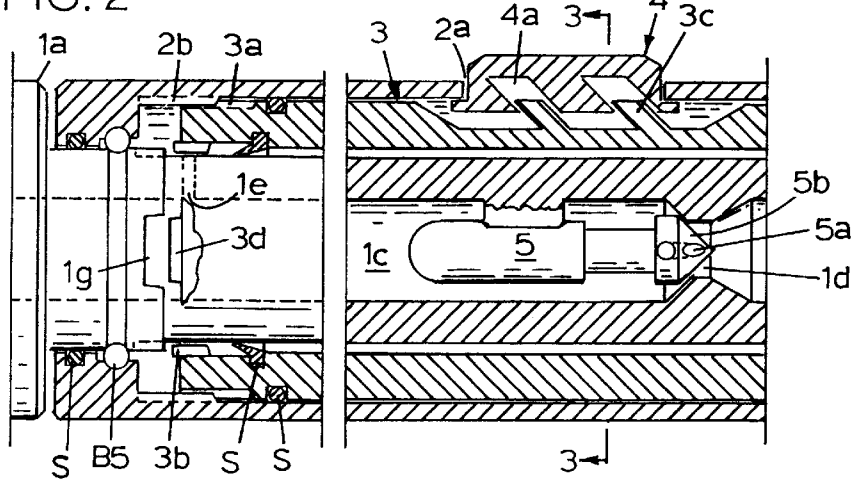
FIG. 2 is a partial side elevation, similar to that of FIG. 1, but shown in the actuated state.

The valve actuator 16 is operated in the manner described herein for the apparatus of FIGS. 1, 2, and 3.

For all figures herein the member or assembly that carries the means to connect to other drill string elements is defined as a spindle, arbor or mandrel. For descriptive purposes, the overall enclosure is definable herein as a body.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, I claim:

1. Apparatus for use on fluid conducting drill strings in earth well bores to apply a lateral force against one side of the well bore to displace the drill string in the opposite lateral direction to change the course of an advancing drill head, the apparatus comprising:

a) a body arranged to serve as a length of fluid conducting drill string, with means at each end for fluid tight attachment to elements of a continuing drill string, with a fluid channel to conduct drilling fluid between said elements of continuing drill string;

b) an arbor comprising both said ends, and said fluid channel;

c) a generally tubular housing bearingly supported on said arbor for rotation thereon;

d) a piston in said housing arranged to move between a first and a second position;

e) clutch means in said housing, responsive to movement of said piston to releasably secure said housing rotationally to said arbor such that said clutch is engaged when said piston is in said first position and disengaged when said piston is in said second position;

f) a side loading element carried, for well bore wall engagement, by said housing, responsive to movement of said piston, to move radially outward from said housing when said piston moves toward said second position and to move radially inward when said piston moves toward said first position;

g) a valve in said channel to variably resist movement of fluid therethrough in response to signals from a source external to the apparatus;

h) fluid ports in said arbor to conduct drilling fluid from said channel arranged such that fluid pressure difference across said valve is conducted to opposite ends of said piston such that increasing pressure across said valve applies increasing force to said piston to move from said first toward said second position; and i) a spring situated in said housing and arranged to urge said piston toward said first position.

2. The apparatus of claim 1 wherein said piston moves axially in said housing within a chamber formed by an annular opening in said housing, with fluid seals between housing and arbor, said piston fluidly sealed at both ends to divide said chamber to provide first and second chambers separated by said piston.

3. The apparatus of claim 1 wherein said valve is actuated by signals from a signal source at the earth surface.

4. Apparatus for use on fluid conducting drill strings in earth well bores to apply a lateral force against one side of the well bore to displace the drill string in the opposite lateral direction, the apparatus comprising:

a) a mandrel arranged to serve as a length of drill string with fluid tight attachment means at opposite ends to attach to continuing drill string elements, with a drilling fluid channel arranged to conduct drilling fluid between said attached elements, and a reduced diameter, generally cylindrical, length between said attachment means;

b) a generally cylindrical housing arranged for rotation, and axial constraint, about said reduced diameter, a generally cylindrical annular opening, fluidly sealed at each end relative to said mandrel, extending some preselected distance about said reduced diameter, and a window opening through the wall of said housing;

c) a piston situated in said annular opening for axial movement therein between a first position and a second position and to separate said opening into first and second fluidly sealed chambers;

e) a valve in said channel, with an upstream side and a downstream side, situated to change the resistance to flow of fluid in said channel;

f) a first fluid communication port to conduct fluid between said upstream side of said valve and said first chamber;

g) a second fluid communication port to conduct fluid between said downstream side of said valve and said second chamber;

h) a spring in said second chamber arranged to urge said piston toward said first end;

i) a well bore wall loading element arranged to extend through said window for lateral movement therethrough;

j) cam surfaces on said piston arranged to cooperate with surfaces on said wall loading element to urge said element radially outward when said piston moves toward said second chamber and to urge said element radially inward when said piston moves toward said first chamber; and k) clutch means, responsive to movement of said piston, to rotationally connect said arbor and said housing when said piston moves to said first position and to rotationally release said arbor and said housing when said piston moves toward said second position.

5. The apparatus of claim 4 wherein said chambers are sealed by closures between said housing and said mandrel and by seals on said piston.

6. The apparatus of claim 4 wherein said valve is actuated by signals generated external to the apparatus.

7. The apparatus of claim 4 wherein said valve is activated by signals transmitted from the earth surface.

8. The apparatus of claim 4 wherein said clutch comprises engagement surfaces on said piston to rotationally connect to both mandrel and housing.

9. Apparatus for use on fluid conducting drill strings in earth well bores to apply a lateral force against one side of the well bore to displace the drill string in the opposite lateral direction to change the course of an advancing drill head, the apparatus comprising:

a) an arbor, arranged to function as a length of drill string, with means at each end for attachment to continuing drill string elements, with a fluid channel extending therethrough to conduct drilling fluid between said continuing drill string elements;

b) an elongated generally cylindrical housing, disposed about said arbor, bearingly supported and fluidly sealed for rotation and axial constraint thereon with a generally cylindrical bore to provide an annular opening extending some axial distance between said housing and said arbor, with surfaces describing a laterally directed opening through one wall;

c) a piston situated for axial movement in said annular opening between first and second axial positions and to provide rotational, and fluid tight, continuity between opposite ends of said arbor;

d) a valve, having an upstream and a downstream side, carried by said piston situated to variably restrict flow of drilling fluid in said channel;

e) a clutch means, responsive to movement of said piston, to releasably engage said arbor and said housing, when said piston is in said first position;

f) fluid ports to fluidly communicate said channel and said annular opening arranged such that pressure difference across said valve is imposed upon said piston such that increasing pressure drop across said valve increasingly urges said piston from said first to said second position;

g) a spring in said opening situated to urge said piston toward said first position;

h) a well bore side loading element arranged to extend through said window for lateral movement therein; and i) cam means on said element and said piston to radially extend said element when said piston moves toward said second end and to retract said element when said piston moves toward said first end.

10. The apparatus of claim 9 wherein said piston provides said rotational continuity between opposite ends of said arbor by way of telescoping mating, noncircular surfaces between said piston and said ends.

11. The apparatus of claim 9 wherein said annular opening is divided into two separate variable volume chambers, separated by said piston, each chamber sealed by closures between each end of said housing and said arbor and between each end of said piston and the walls of said chamber.

12. The apparatus of claim 9 wherein said valve is actuated by signals from a signal source external to said apparatus.

* * * * *